US005719610A

United States Patent [19]

Scheffelin

[11] Patent Number: 5,719,610

[45] Date of Patent: Feb. 17, 1998

[54] METHOD AND APPARATUS FOR REGULATING REPLENISHMENT INK FLOW TO A PRINT CARTRIDGE

[75] Inventor: Joseph E. Scheffelin, San Diego, Calif.

[73] Assignee: Hewlett-Packard Company, Palo Alto, Calif.

[21] Appl. No.: 869,243

[22] Filed: Jun. 4, 1997

Related U.S. Application Data

[63] Continuation of Ser. No. 314,978, Sep. 29, 1994, abandoned.

[51] Int. Cl.[6] ..... B41J 2/175; E03B 7/07

[52] U.S. Cl. ..... 347/86; 137/614.04

[58] Field of Search ..... 347/86, 85; 137/614.03, 137/630.15, 614.06 J, 614.05, 614.04; 141/346, 348, 349, 351–354

[56] References Cited

U.S. PATENT DOCUMENTS

| | | | |
|---|---|---|---|
| 3,896,853 | 7/1975 | Bernhard | 137/614.05 |
| 5,448,818 | 9/1995 | Scheffelin et al. | 347/86 |
| 5,467,806 | 11/1995 | Stricklin et al. | 141/348 |

FOREIGN PATENT DOCUMENTS

| | | | |
|---|---|---|---|
| 61-284445 | 11/1986 | Japan | 347/86 |
| 678556 | 9/1952 | United Kingdom | 137/614.03 |

*Primary Examiner*—Benjamin R. Fuller
*Assistant Examiner*—Judy Nguyen

[57] ABSTRACT

Apparatus for regulating the flow of replenishment ink from an ink reservoir to a print cartridge. The apparatus includes two valves which enter into a mating relationship and together open with respect their valve seats and thereby permit the transfer of replenishment ink from a reservoir to a print cartridge.

10 Claims, 6 Drawing Sheets

METHOD AND APPARATUS FOR REGULATING REPLENISHMENT INK FLOW TO A PRINT CARTRIDGE

CROSS REFERENCE TO RELATED APPLICATION(S)

This is a continuation of application Ser. No. 08/314,978 filed on Sep. 29, 1994, now abandoned.

FIELD OF INVENTION

The present invention generally relates to print cartridges that are received in computer controlled printers and, more particularly, to methods and apparatus for refilling such print cartridges.

BACKGROUND OF THE INVENTION

Printers are devices that print characters onto a printing medium such as paper or polyester film and are commonly controlled by a computer that supplies the image in the form of print commands. Some printers use a colorant-containing liquid which may be either a dye or a polymer. These liquids are termed "ink" in the printer industry. The printer forms images on the printing medium by delivering ink to the medium using a print head that creates the proper patterns of ink to record the image permanently.

One type of printer is the ink-jet printer which forms a small droplets of ink that are ejected toward the printing medium in a precise pattern of dots. When viewed at a distance, the collection of dots forms the image in much the same manner as photographic images are formed in newspapers. Ink-jet printers are fast, produce high quality printing, and are quiet because there is no mechanical impact during operation.

Typically, an ink-jet printer has a large number of individual ink nozzles that are arranged in arrays in the print head. The print head is supported in a carriage, and the ink nozzles are oriented in a facing, but spaced apart, relationship to the printing medium. The carriage and the printhead traverse over the surface of the medium again and again with the nozzles ejecting droplets of ink at appropriate times under the command of the Computer. After each transverse by the print head, the printing medium is moved an increment in the direction lateral to the transverse and thereafter the carriage with the print head traverses the page again to deposit another swath. In this manner the entire pattern of dots that forms the image is progressively deposited one swath at a time by the print head.

In a thermal ink-jet printer the ejection of droplets is accomplished by heating a small volume of ink adjacent the nozzle, vaporizing a bubble of ink, and thereby driving a droplet of ink through the nozzle toward the printing medium. The droplets strike the medium and then dry to form "dots" that, when viewed together, form one swath of the permanently printed image.

In some types of printers the ink is stored in a reservoir that is mounted on the carriage along with the print head. Ink is then delivered by capillary action to the nozzles. In these printers the print head is a single-use, consumable, disposable unit that may be readily inserted and removed from the printer when the ink reservoir is exhausted. One such printer and the print cartridges for it are described in *Hewlett-Packard Journal*, February 1994, Volume 45, Number 1.

In the early stages of the development of thermal ink-jet printers, the useful life of a print head was usually determined by the length of time until the first nozzle failed. More recently the design of nozzles and print heads has so advanced that the life of the nozzles prior to failure has significantly lengthened. In other words, the supply of ink in a reservoir may now be exhausted before a nozzle failure is experienced. Thus, there now exists a need for a larger supply of ink to be available for print cartridges because of the extended nozzle life.

Simply increasing the size of the ink reservoir has not proved to be an acceptable solution however. Typically, a reservoir is supported on the printer carriage and moves with the print head. Increasing the size of the reservoir would necessarily increase the size and weight of the structure that supports and moves the carriage back and forth. This would cause the performance of the printer to suffer because of the increased mass of the carriage and would also significantly increase the cost of the printer.

Still another solution would seem to be to refill the empty print cartridges with replenishment ink. This would allow the print heads to be used again and again until nozzle failure. As of yet this approach has not proven to be reliable or satisfactory because of at least four significant problems.

The first problem and probably the most significant from the operator's point of view is how to transfer ink from a replenishment ink reservoir to the print cartridge while avoiding spillage and leakage. No operator wants to have his or her hands, clothing, or work areas stained by spilled ink.

The second problem is maintaining the operating pressure in the print cartridge during the next operating cycle. Normally, print cartridges operate at a pressure range of approximately two to four inches of an inch of water below atmospheric pressure, and the ink is supplied to the nozzles at this pressure by capillary action. In some print cartridges the pressure of the ink in the reservoir is maintained by a collapsible ink bag and a spring which urges the walls of the ink bag apart against atmospheric pressure. If the pressure of the ink exceeds a maximum level, ink will be forced out of the nozzles and the print cartridge will "drool" ink onto the paper and into the printer. If the pressure of the ink in the print cartridge drops below a minimum level, the flow of ink to the nozzles will stop because the capillary pressure is exceeded.

A third problem is maintaining the pressure of the ink in the print cartridge during refilling. If the pressure of the ink exceeds a maximum level during refilling, then ink will drool from the nozzles and leakage will occur. If the pressure in the print cartridge drops below a minimum level, then air may be drawn into the nozzles which may block the passage of ink and cause nozzle failure.

A fourth problem is the inadvertent introduction of air or gases into the print cartridge during replenishment. If bubbles are entrapped in the print cartridge during replenishment, these bubbles can travel within the print cartridge and block the narrow passage ways leading to the print nozzles and thereby cause nozzle failure.

It will be apparent from the foregoing that although there are many processes and apparatus for refilling print cartridges, there is still a need for an approach that avoids spillage and leakage and properly maintains the pressure within the print cartridge during refilling and the next operating cycle.

SUMMARY OF THE INVENTION

The present invention provides a method and apparatus for replenishing print cartridges in a clean, efficient manner without introducing air bubbles or other gases into the print cartridge. The apparatus disclosed herein is compact, efficient, and easy to manufacture and use.

Briefly and in general terms, an apparatus according to the invention includes a flanged housing on an replenishment ink reservoir, an annular boss attached to the ranged housing for receiving a print cartridge, and a slide valve mounted within the housing and coaxial with the boss for longitudinal reciprocal motion between a valve open position and a valve shut position so that the flow of replenishment ink from the reservoir to the print cartridge may be regulated.

The invention also contemplates a second ranged housing on a print cartridge, a boss attached to this ranged housing having an annular bore and a slide valve mounted within the flanged housing and coaxial with the annular bore for longitudinal reciprocal motion between a valve open position and a valve shut position so that the flow of replenishment ink from the reservoir to the print cartridge may be regulated.

In operation, as the two flanged housings come together, the two slide valves begin to engage in a mating relationship that opens the slide valves one after the other. The ink in the reservoir is maintained at a sufficiently higher pressure than the sub-atmospheric pressure in the print cartridge so that ink flows from the reservoir to the print cartridge.

Other aspects and advantages of the invention will become apparent from the following detailed description, taken in conjunction with the accompanying drawings, illustrating by way of example the principles of the invention.

DESCRIPTION OF THE PREFERRED EMBODIMENT

Figure 1:
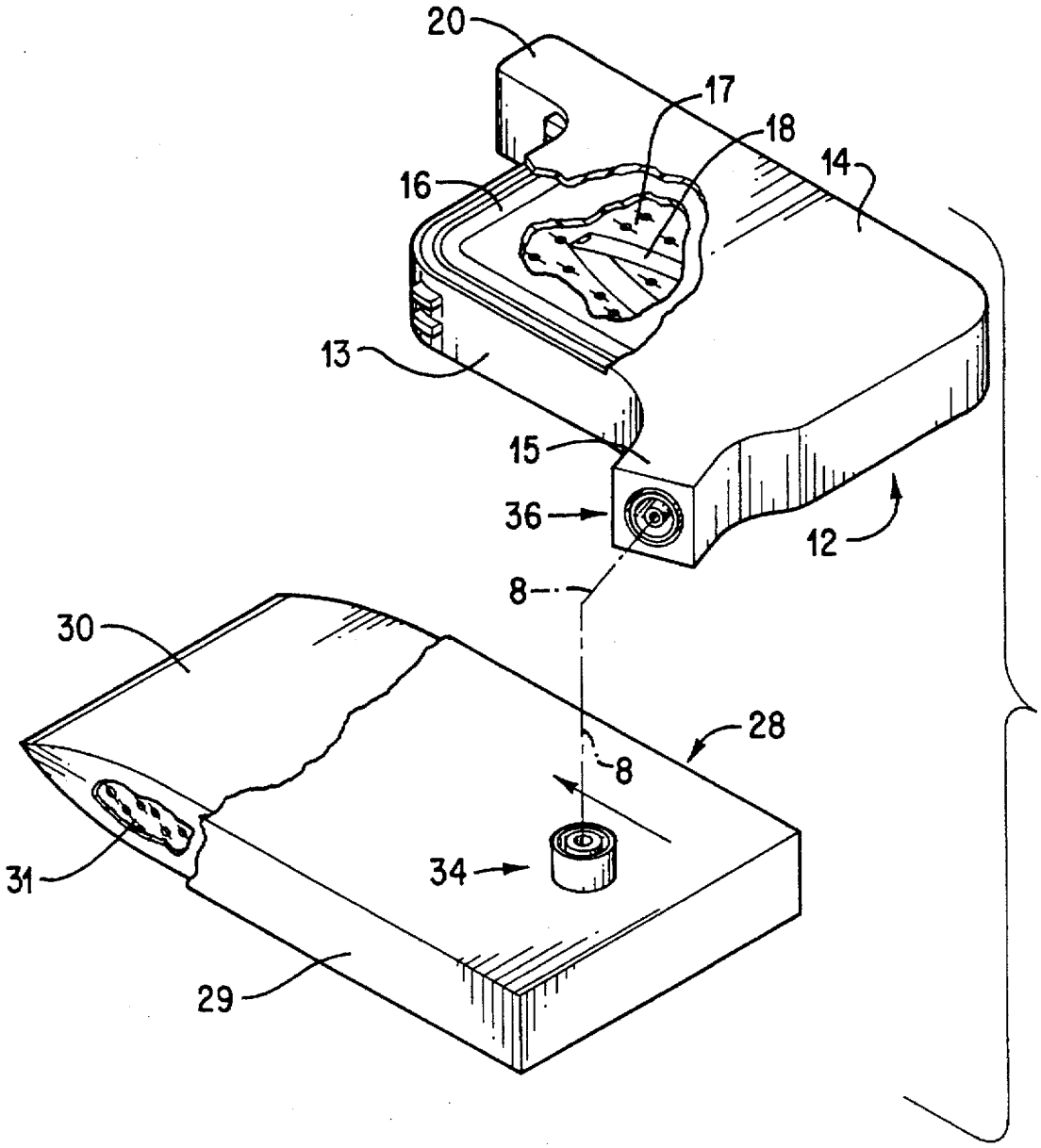
FIG. 1 is an exploded, diagrammatic view, partially cut away, of a print cartridge and a replenishment ink reservoir embodying the principles of the invention.

As shown in the drawings for the purposes of illustration, the invention is embodied in an apparatus for regulating the flow of replenishment ink from a replenishment ink reservoir to a print cartridge. The apparatus includes a flanged housing attachable to a casing of the replenishment ink reservoir and a second flanged housing attachable to a frame of the print cartridge. Each housing also includes an annular boss. One annular boss contains an annular bore that receives the boss of the other flanged housing. The bore and the boss are received together in annular sliding relationship which guides the two flanged housings together and apart. The flanged housings also each contain a slide valve that is mounted coaxially to its annular boss for longitudinal reciprocal motion between a valve open position and a valve shut position. As the flanged housings come together, the two slide valves engage and mate. The motion of bringing the housings together further causes the slide valve on the replenishment reservoir to open, followed thereafter by the slide valve on the print cartridge. Replenishment ink then flows from the reservoir to the print cartridge. Of course the flanged housing of the replenishment ink reservoir could be constructed as part of the casing, and the print cartridge flanged housing could be constructed as part of the frame.

Referring to FIG. 1, reference numeral 12 generally indicates a print cartridge that may be inserted in a computer controlled printer (not shown). The print cartridge 12 includes a rigid frame 13 and a side wall 14. In FIG. 1 the side wall 14 is cut away to illustrate the interior of the print cartridge. Within the print cartridge is a deformable ink bag 16 that collapses as the ink is expelled from the print cartridge. The pressure within the ink bag is maintained at sub-atmospheric pressure by a spring 18 which urges the walls of the collapsible ink bag apart in opposition to the atmospheric force on the ink bag causing it to collapse. The print cartridge 12 further includes a handle 15 which is an aid to insert the print cartridge into the printer (not shown). The print cartridge 12 further includes a print head 20 which ejects droplets of ink on command under control of the printer (not shown).

The construction, fabrication and operation of the print cartridge 12 is further described in the *Hewlett-Packard Technical Journal* referenced above.

Referring to FIG. 1, reference numeral 28 indicates an ink reservoir containing replenishment ink for the print cartridge 12. The ink reservoir includes a rigid casing 29 that contains a collapsible ink bag 30. In FIG. 1 the casing 29 is shown cut away to illustrate the ink bag 30. The ink bag contains replenishment ink 31 which will be transferred from the ink reservoir 28 to the print cartridge 12 according to the present invention.

Referring to FIG. 1, the print cartridge 12 further includes a print cartridge valve 36 located within the handle 15 of the housing 13. The print cartridge valve 36 is located in this position so that the walls of the handle 15 may protect the valve from accidental opening and also to preserve the smooth and pleasant exterior appearance of the print cartridge 12. Reference numeral 34 generally indicates a reservoir valve located on the housing 29 of the ink reservoir 28. The reservoir valve 34 and the print cartridge valve 36 are configured to come together in a mating relationship, to open and close internal slide valves as described herein below and to transfer replenishment ink from the ink reservoir 28 to the ink bag 16. Using the slide valves, the reservoir valve 34 can be placed into liquid communication with the ink 31 within the collapsible bag 30 of the ink reservoir 28. Likewise the print cartridge valve 36 can be placed into fluid communication with the ink 17 in the ink bag 16 within the housing 13 of the print cartridge 12.

Figure 2:
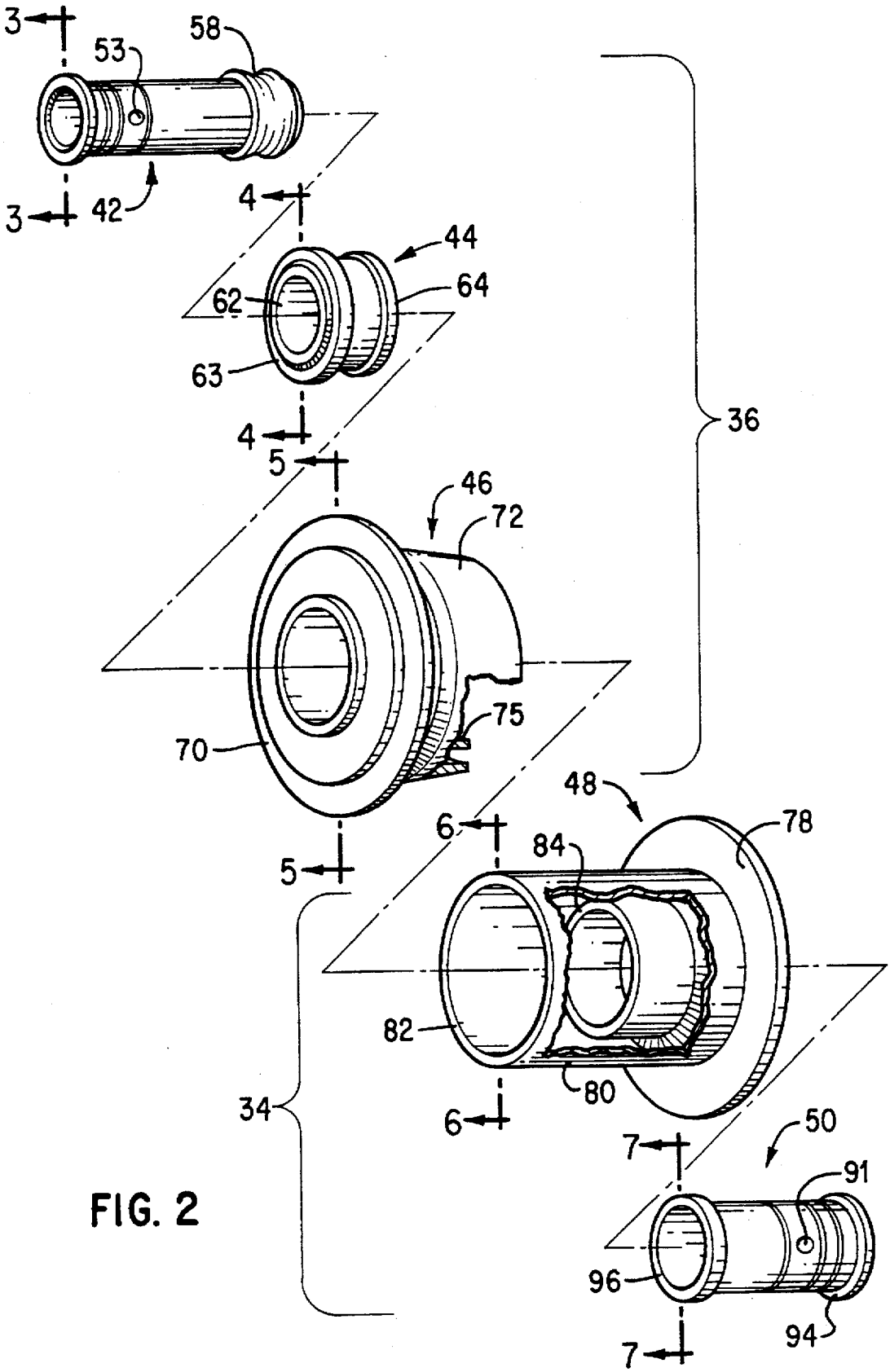
FIG. 2 is an exploded, diagrammatic view, partially cut away, of an apparatus for regulating replenishment ink flow from a replenishment ink reservoir to a print cartridge.

Referring to FIGS. 1 and 2, the print cartridge valve 36 includes a cartridge slide valve 42, a grommet 44 and a flanged housing 46. Further, the reservoir valve 34 includes a flanged housing 48 for the reservoir 28 and a reservoir slide valve 50 which is received in the flanged housing.

Of course the grommet 44 and flanged housing 46 could be constructed as part of frame 13 to form a unitary member. Where the frame is formed by two dissimilar materials such as an inner softer plastic portion and a outer harder plastic portion (see co-pending application Ser. No. 07/994,807, filed Dec. 22, 1992 entitled "Two Material Frame Having Dissimilar Properties For Thermal Ink-Jet Cartridge" which co-pending application is assigned to the same assigned as the present application and which is incorporated herein by reference), the grommet could be formed as part of the inner frame portion and the flanged housing as part of the outer frame portion.

Figure 3:
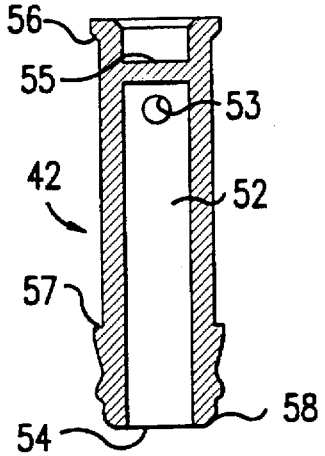
FIG. 3 is a side elevational view in cross section taken along line 3—3 of the apparatus of FIG. 2.

Referring to FIGS. 2 and 3, the cartridge slide valve 42 has an elongate cylindrical shape and contains an internal conduit 52. This conduit connects a port 53 in the side wall of the slide valve 42 with a port 54 in the end wall of the slide valve. The conduit is blocked by an end wall 55 located internally within the slide valve 42. At one end of the cylindrical slide valve 42 is a circumferential shoulder 56 that acts as a stop as described below. At the other, distal end 58 of the slide valve is a coaxial, deformable and radially compressible circumferential surface. This surface has a generally convex shape and is adapted for releasably receiving the ink reservoir valve 34 in a mating relationship as described below. The cartridge slide valve 42 further includes a circumferential shoulder 57 located near the distal end 58.

Figure 4:
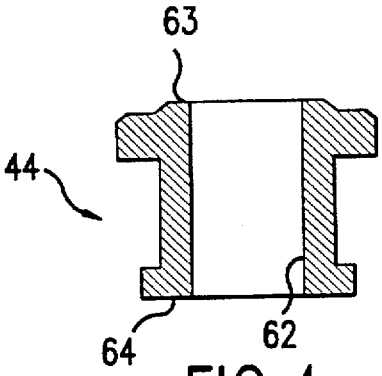
FIG. 4 is a side elevational view in cross section taken along line 4—4 of the apparatus of FIG. 2.
Figure 8:
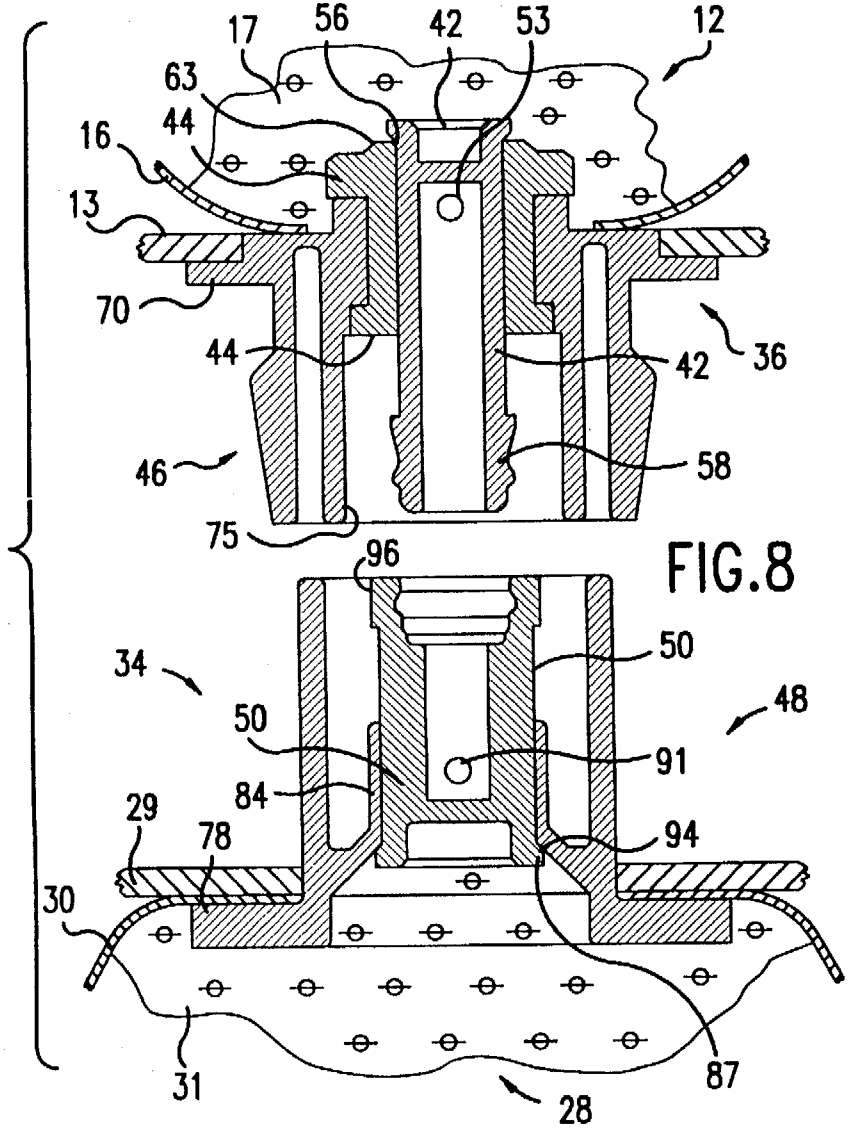
FIG. 8 is a side elevational view in cross section taken along line 8—8 of the embodiment of FIG. 1.

Referring to FIGS. 2, 4 and 8, the grommet 44 has a generally cylindrical, hollow shape that receives the cartridge slide valve 42 for longitudinal reciprocal motion as described below. The grommet has a coaxial, longitudinal interior bore 62 that receives the cartridge slide valve 42 as illustrated in FIG. 8. The grommet 44 further includes an annular shoulder 63 and an annular shoulder 64 located on the opposing end walls of the grommet. The grommet 44 is received within the bore 75 of the flanged housing 46, FIG. 5. The grommet does not move with respect to the flanged housing and acts as a bearing surface permitting longitudinal reciprocal motion of the slide valve 42.

Figure 5:
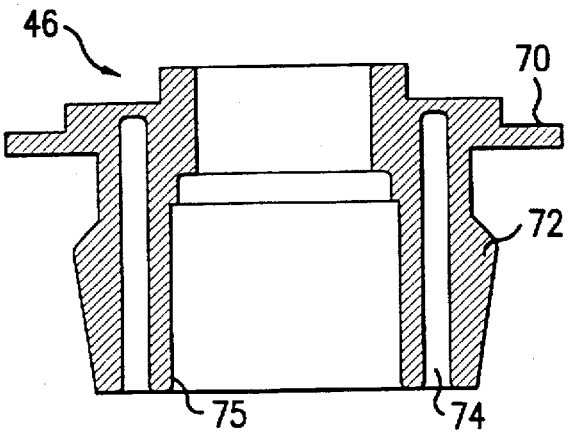
FIG. 5 is a side elevational view in cross section taken along line 5—5 of the apparatus of FIG. 2.

Referring to FIGS. 2 and 5, the flanged housing 46 for the cartridge has a generally cylindrical, elongate, hollow shape. The housing 46 includes a flange 70 which can be attached to the frame 13 of the print cartridge 12, FIG. 1. The housing 46 further includes a boss 72 having a generally cylindrical shape attached to the flange 70. The boss has an annular bore 74 and a cylindrical, central bore 75 that are coaxial. As illustrated in FIG. 5, the bore 74 does not pass through the flange 70 whereas the bore 75 passes completely through the flange 70. The flanged housing 46 receives the grommet 44 within the cylindrical bore 75 as illustrated in FIG. 8 and acts as a bearing for the longitudinal movement of the slide valve 42 as described below.

Figure 6:
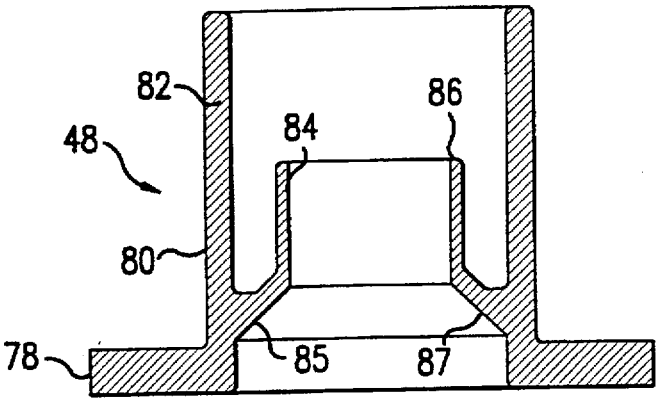
FIG. 6 is a side elevational view in cross section taken along line 6—6 of the apparatus of FIG. 2.

Referring to FIGS. 2 and 6, the flanged housing 48 for the reservoir 28, FIG. 1, has a generally elongate, hollow, cylindrical shape. The housing 48 includes a flange 78 which can be attached to the casing 29, FIG. 1, of the ink reservoir as described below. The housing 48 further includes a boss 80 having a generally hollow, cylindrical shape that is attached to the flange. The boss includes an outer cylindrical, annular side wall 82 and an inner cylindrical, annular side wall 84 that are both coaxial. As illustrated in FIG. 6 the bore of the inner annular side wall 84 passes completely though the housing while, in contrast, the bore of the outer cylindrical side wall 82 does not. This outer bore is blocked by an end wall 85 which is a web connecting side wall 82 and side wall 84 as illustrated in FIG. 6. The housing 48 further includes a shoulder 86 which is the annular end wall of the inner cylindrical side wall 84. The housing also includes a second shoulder 87 which is on the end wall of the web 85. Of course, the flanged housing 48 could be constructed as part of the casing 29.

Figure 7:
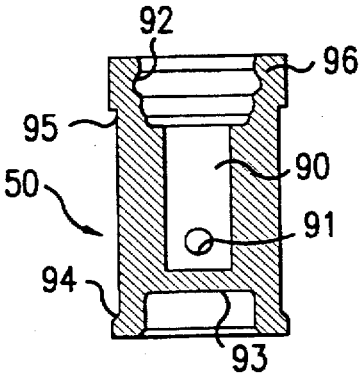
FIG. 7 is a side elevational view in cross section taken along line 7—7 of the apparatus of FIG. 2.

Referring to FIGS. 2 and 7, the slide valve 50 for the reservoir 28, FIG. 1 has a generally elongate, cylindrical shape. The slide valve includes an internal conduit 90 that connects a port 91 in the side wall of the slide valve to a port 92 in the end wall of the valve. The conduit is blocked by an end wall 93 within the valve 50. The valve further includes a shoulder 94 having a generally circumferential shape on the end of the valve. The valve also includes a shoulder 95 having a complementary circumferential shape located opposite the shoulder 94. These shoulders act as stops as described below. The slide valve 50 further includes a distal end 96 having a coaxial, deformable, radially expandable, circumferential surface. This surface has a generally concave shape and is adapted for receiving the cartridge slide valve 42, FIG. 3 in a releasable, mating relationship.

FIG. 8 illustrates the reservoir valve 34 and the cartridge valve 36 in coaxial relationship just immediately before mating or after unmating. The cartridge valve 36 is connected to the print cartridge 12 at the flange 70 as illustrated in FIG. 8. The rigid housing 13 and the ink bag 16 are bonded to the flange 70 to contain the ink 17 in the print cartridge 12. Likewise, the reservoir valve 34 is connected to the ink reservoir 28 by the flange 78. The casing 29 and the ink bag 30 of the reservoir 28 are bonded to the flange to contain the ink 31.

It should be noted that for simplicity in FIG. 8 the handle 15 is not illustrated, and in FIGS. 9 through 13 the ink 17, 31 and the frame 13 and casing 29 are not illustrated.

The structural elements of the valves may be constructed of polyethylene or other similar materials as long as the material is resistant to chemical attack by the ink.

FIG. 8 illustrates the reservoir valve 34 and the print cartridge valve 36 aligned in a coaxial relationship just immediately before mating or after unmating. FIG. 8 illustrates the first step of the process of transferring replenishment ink 31 from the ink reservoir 28 to the print cartridge 12. It should be noted that both slide valves of 42 and 50 are in the valve shut position. In other words, the port 53 on the side wall of the slide valve 42 is covered by the grommet 44 and the side wall port 91 of the slide valve 50 is covered by the inner annular side wall 84 of the flanged housing 48 of the reservoir. In the position illustrated in FIG. 8 the ink 17, 31 is sealed in their respective ink bags 16, 30 and there is no leakage or flow out of either bag. It should further be noted that the shoulder 56 on the cartridge slide valve 42 is in physical contact with the shoulder 63 of the grommet 44. Further, the shoulder 94 of the reservoir slide valve 50 is in physical contact with the shoulder 87 of the flanged housing for the reservoir.

Figure 9:
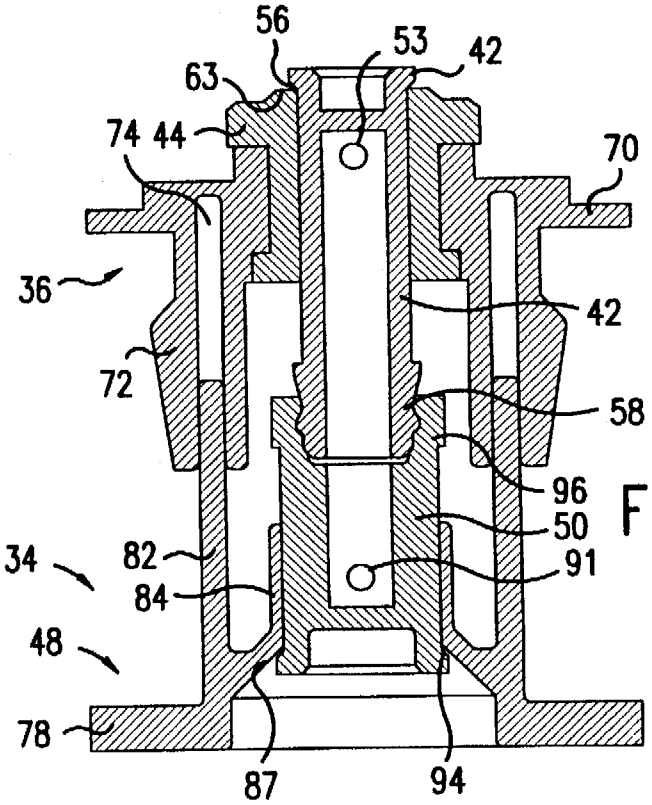
FIG. 9 is a side elevational view of the apparatus of FIG. 8 illustrating how the slide valves mate together and how the bosses maintain co-axial alignment.

FIG. 9 illustrates the establishment of a mating relationship between the print cartridge valve 36 and a reservoir valve 34. In particular, the distal end 58 of the slide valve 42 has been radially compressed while the distal end 96 of the slide valve 50 has been radially expanded. The two distal ends have moved together and have formed a liquid tight seal. The relative movement between the two slide valves 42, 50 while in this mating relationship has ceased. Further in FIG. 9, the outer cylindrical side wall 82 of the flanged housing 48 has been received within the annular bore 74 of the boss 72. The bore 74 and the side wall 82 are in coaxial, cylindrical relationship and served to guide the reservoir valve 34 and the cartridge valve 36 as the valves slide together and apart. It should further be noted in the FIG. 9 that although the distal ends 58 and 96 have engaged in a mating relationship, the shoulders 56, FIG. 3 and 94, FIG. 7 remain in physical contact with the shoulders 63, FIG. 4 and 87, FIG. 6.

Figure 10:
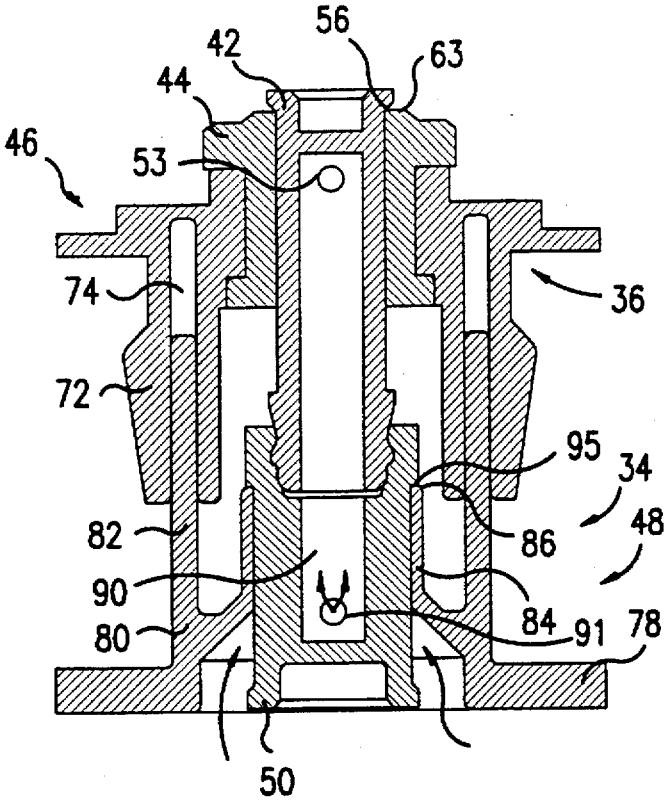
FIG. 10 is a side elevational view of the apparatus of FIG. 8 illustrating the opening of the slide valve in the housing on the reservoir.

After the mating relationship illustrated in FIG. 9 has been established, the reservoir valve 34 and print cartridge valve 36 continue to move together as illustrated in FIG. 10. The outer cylindrical side wall 82 of the boss 80 slides further and deeper into the annular bore 74 of the boss 72. Of the slide valves 42, 50 now mated together, the valve with the least frictional resistance moves first with respect to its housing. In the preferred embodiment the slide valve 50 of the reservoir moves first because of its larger diameter. The slide valve 50 moves until the shoulder 95 comes into physical contact with the shoulder 86 on the flanged housing 48. This motion uncovers the port 91 in the side wall of the internal conduit 90, and ink is thus permitted to flow from the reservoir 28, FIG. 1 into the internal conduit 90. It should be noted in FIG. 10, that the slide valve 42 has not moved with respect to the flanged housing 46 because the slide valve 42 has a greater frictional resistance than slide valve 50. Thus, the port 53 in the side wall of the slide valve 42 remains covered by the grommet 44 and the shoulder 56 remains in physical contact with the shoulder 63 on the grommet 44.

Figure 11:
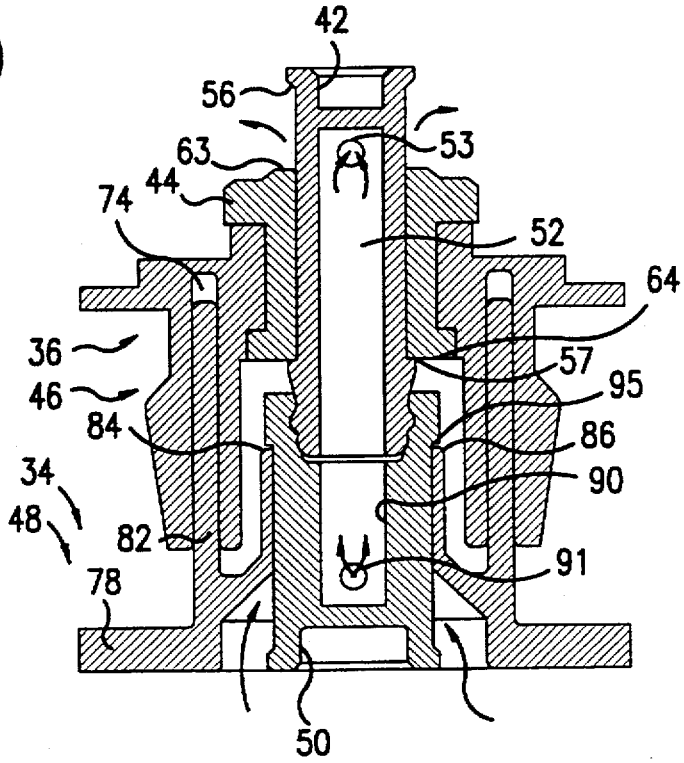
FIG. 11 is a side elevational view of the apparatus of FIG. 8 illustrating the opening of the slide valve in the housing on the print cartridge.

The motion of the reservoir vane 34 and the print cartridge valve 36 described in FIG. 10 is continued in FIG. 11. The flanged housing 46 moves closer to the flanged housing 48 and the cylindrical side wall 82 penetrates more deeply into the annular bore 74. The flange 78 and the inner side wall 84 engage the slide valve 50 at the shoulders 86, 95 and move the slide valve 50 together with the slide valve 42. The flanged housing 48, the slide valve 50, and the mated slide valve 42 move together as one unit relative to the flanged housing 46 and the grommet 44. This motion continues until the shoulder 57 on the slide valve 42 engages the shoulder 64 on the grommet 44, and motion comes to a stop. The port of 53 in the side wall of the slide valve 42 is thereby uncovered. In FIG. 11 ink flows from the reservoir 28, FIG. 1, through the port 91 of the slide valve 50, up through the internal conduits 90 and 52, through the port 53 in the side wall of the slide valve 42, and thereafter into the ink bag 16 of the print cartridge 12, FIG. 1. The flow of ink occurs either because the pressure in the reservoir 28 is sufficiently larger than the pressure in the ink bag 16 or the ink flows downward under the force of gravity (upside down from the manner illustrated).

Figure 12:
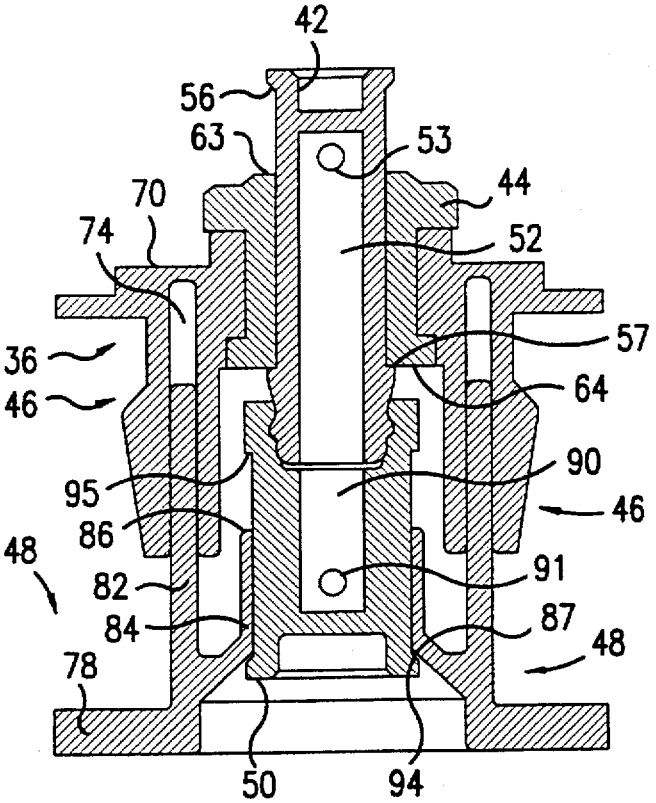
FIG. 12 is a side elevational view of the apparatus of FIG. 8 illustrating the shutting of the slide valve in the housing on the reservoir.

Referring to FIG. 1, after replenishment of the print cartridge 12 has been completed, the flow of ink from the reservoir 28 to the print cartridge 12 ceases. Thereafter, the print cartridge 12 is removed from the ink reservoir 28 and in so doing the reservoir valve 34 is moved relative to the print cartridge valve 36. Referring now to FIG. 12, since the slide valve 50 on the reservoir has less resistance, the flanged housing 48 moves first with respect to the slide valve 50. Shoulders 86 and 95 move away from physical contact and from each other. It should be noted in FIG. 12 that the flanged housing 46 moves together with the slide valve 42 and the slide valve 50 relative to the flanged housing 48. It should also be noted that the shoulder 57 on the slide valve 42 remains in physical contact with the shoulder 64 on the grommet 44. Motion of the flanged housing 48 continues with respect to the slide valves 42, 50 until the shoulder 94 on the slide valve 50 engages the shoulder 87 on the housing 48.

Figure 13:
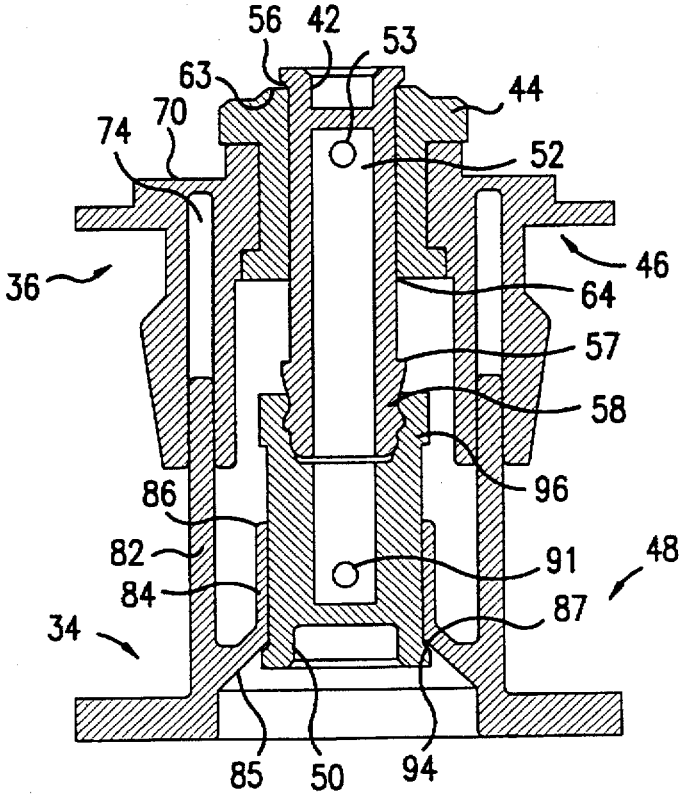
FIG. 13 is a side elevational view of the apparatus of FIG. 8 illustrating the shutting of the slide valve in the housing on the print cartridge.

As illustrated in FIG. 13, the print cartridge 12, FIG. 1, continues to be withdrawn from the ink reservoir 28. In FIG. 13 the slide valve 42 commences to move with respect to its housing 46 because the slide valve 50 has its shoulder 94 engaging shoulder 87 on the housing 48. Shoulders 57 and 64 move away from physical contact and from each other. The reservoir valve 34 continues to move away relative to the print cartridge valve 36 until the position illustrated in FIG. 13 is reached. At that point the shoulder 56 of the slide valve 42 engages the shoulder 63 on the grommet 44. No further relative motion of the slide valve 42 can occur with respect to the housing 46 in a direction away from each other or the slide valve 50 with respect to the housing 48.

Further motion of the reservoir valve 34, FIG. 13, away from the print cartridge valve 36 causes the distal ends 58, 96 to. disengage from their mating relationship, to snap apart, and the reservoir valve 34 and the print cartridge valve 36 to take on the positions illustrated in FIG. 8.

Although in the preferred embodiment the reservoir valve 34 and the print cartridge valve 36, FIGS. 8 and 9 came into mating relationship first and then the slide valve 50 moves followed by the slide valve 42, it should be appreciated that other combinations of motion and mating are contemplated to be within the scope of the apparatus and process. It is contemplated that the slide valves 42, 50 can in alternative embodiments move simultaneously or with the slide valve 42 moving initially with respect to the slide valve 50. Further, it is contemplated that the mating relationship illustrated in FIG. 9 could occur either at the beginning, during or at the end of the sequence in which the reservoir valve 34 is brought into gagement with the print cartridge valve 36.

Although specific embodiments of the invention have been described and illustrated, the invention is not to be limited to the specific forms or arrangements of parts so described and illustrated. The invention is limited only by the claims.

We claim:

1. An apparatus for supplying ink to a print cartridge comprising:

a housing for an ink reservoir;

an annular seal connected to said housing; and a first slide valve co-axial to said annular seal for longitudinal reciprocal motion between a valve open position and a valve close position, said first slide valve comprising:

a shaft having a central bore, said shaft having an open first end, said shaft having at least one opening proximate to a second end, said valve open position being such that said at least one opening is in fluid communication with ink within said ink reservoir, said valve close position being such that said at least one opening is blocked by said annular seal;

at least one ridge forming part of said central bore at said first end of said shaft, said at least one ridge providing a latching structure for latching to an end of a second valve on a print cartridge when said end of said second valve is inserted into said central bore of said first slide valve for recharging said print cartridge with ink, said longitudinal reciprocal motion of said first slide valve between said valve open position and said valve close position being such that said end of said second valve, when inserted into said central bore of said first slide valve, latches onto said at least one ridge to form a fluid seal between said central bore of said first slide valve and a central bore of said second valve prior to said first slide valve being slid into said valve open position, said at least one ridge also being formed such that said at least one ridge disengages said end of said second valve after said first slide valve is slid into said valve close position when separating said print cartridge from said first slide valve.

2. The apparatus of claim 2 wherein said first end of said first slide valve is generally concave and radially expandable for releasably engaging said end of said second valve.

3. The apparatus of claim 2 wherein said ink reservoir has a pressure therein that exceeds a pressure in the print cartridge so that replacement ink flows from the ink reservoir to the print cartridge.

4. An apparatus provided on a print cartridge for allowing ink from an external ink reservoir to be supplied to an ink reservoir in said print cartridge, said apparatus comprising:

an annular seal attached to said print cartridge;

a first slide valve co-axial to said annular seal for longitudinal reciprocal motion between a valve open position and a valve close position, said first slide valve comprising:

a shaft having a central bore, said shaft having an open first end, said shaft having at least one opening proximate to a second end, said valve open position being such that said at least one opening is in fluid communication with said ink reservoir within said print cartridge, said valve close position being such that said at least one opening is blocked by said annular seal;

at least one ridge formed on an outer periphery of said shaft at said first end of said shaft, said at least one ridge providing a latching structure for latching to an end of a fluid connector for an external ink reservoir when said first end of said first slide valve is inserted into an opening of said fluid connector for recharging said print cartridge with ink, said longitudinal reciprocal motion of said first slide valve between said valve open position and said valve close position being such that said at least one ridge at said first end of said first slide valve, when inserted into said opening of said fluid connector, latches onto said fluid connector to form a fluid seal between said central bore of said first slide valve and said opening of said fluid connector prior to said first slide valve being slid into said valve open position, said at least one ridge also being formed such that said at least one ridge disengages said fluid connector only after said first slide valve is slid into said valve close position when separating said print cartridge from said fluid connector.

5. The apparatus of claim 4 wherein the print cartridge has a handle for aiding insertion of said print cartridge into a printer, said handle being located at an end of said print cartridge opposite an end where a printhead is located, said annular seal and said first slide valve being located within said handle.

6. The apparatus of claim 4 wherein said first end of said first slide valve is generally convex and radially compressible for releasably engaging said opening of said fluid connector.

7. An ink replenishment system comprising:

a print cartridge having a valve for allowing ink from an external ink reservoir to be supplied to an ink reservoir in said print cartridge, said valve comprising:

a first annular seal attached to said print cartridge;

a first slide valve co-axial to said first annular seal for longitudinal reciprocal motion between a valve open position and a valve close position, said first slide valve comprising:

a first shaft having a central bore, said first shaft having an open first end, said first shaft having at least one opening proximate to a second end, said valve open position being such that said at least one opening is in fluid communication with said ink reservoir within said cartridge, said valve close position being such that said at least one opening is blocked by said first annular seal;

at least one first ridge formed on an outer periphery of said first shaft at said first end of said first shaft;

an external ink reservoir for supplying ink to said print cartridge comprising:

a housing for an ink supply;

a second annular seal connected to said housing; and a second slide valve co-axial to said second annular seal for longitudinal reciprocal motion between a valve open position and a valve close position, said second slide valve comprising:

a second shaft having a central bore, said second shaft having an open first end, said second shaft having at least one opening proximate to a second end, said valve open position being such that said at least one opening in said second shaft is in fluid communication with said ink supply, said valve close position being such that said at least one opening is blocked by said second annular seal;

at least one second ridge forming part of said central bore at said first end of said second shaft;

said at least one second ridge providing a latching structure for latching to said at least one first ridge on said first shaft when said first end of said first slide valve is inserted into said central bore of said second slide valve for recharging said print cartridge with ink, said longitudinal reciprocal motion of said first slide valve and said second slide valve between their respective valve open positions and valve close positions being such that said at least one first ridge of said first slide valve, when inserted into said central bore of said second slide valve, latches onto said at least one second ridge of said second slide valve to form a fluid seal between said central bore of said first slide valve and said central bore of said second slide valve prior to said first slide valve and said second slide valve being slid into their respective valve open positions;

said at least one second ridge also being formed such that said at least one second ridge disengages from said at least one first ridge of said first slide valve only after said first slide valve and said second slide valve are slid into their valve close positions when separating said print cartridge from said external ink reservoir.

8. The apparatus of claim 7 further including a first annular boss surrounding said first annular seal and a second annular boss surrounding said second annular seal, said first annular boss and said second annular boss serving to guide said first slide valve into said second slide valve as said print cartridge and said external ink reservoir are brought together.

9. A method for regulating replenishment ink flow from a reservoir to a print cartridge comprising the following steps:

a) engaging a reservoir valve to a cartridge valve, said reservoir valve being attached to said reservoir and including a first elongate conduit mounted for longitudinal reciprocal motion between a valve open position and a valve shut position, said first elongate conduit having at least one first ridge formed at a first end of said first conduit, said cartridge valve being attached to said print cartridge and including a second elongate conduit mounted for longitudinal reciprocal motion between a valve open position and a valve shut position; said second elongated conduit having at least one second ridge formed at a first end of said second conduit, said step of engaging causing said at least one first ridge and said at least one second ridge to latch together;

b) opening one of the reservoir valve and the cartridge valve;

c) opening, after step b is initiated, the other of the reservoir valve and the cartridge valve;

d) replenishing the print cartridge, after steps a, b, and c, with a flow of ink from the reservoir to the print cartridge;

e) shutting one of the reservoir valve and the cartridge valve by pulling the reservoir valve away from the cartridge valve while said at least one first ridge on said reservoir valve is latched to said at least one second ridge on said cartridge valve;

f) shutting, after step e is initiated, one of the other of the reservoir valve and the cartridge valve; and g) terminating the step of engaging between the reservoir valve and the cartridge valve upon further pulling the reservoir valve away from the cartridge valve.

10. The method of claim 9 wherein the steps a), b), and c) of engaging and opening include the step of bringing the reservoir valve and the cartridge valve together, and the steps e), f) and g) of shutting and terminating include the step of pulling the reservoir valve and the cartridge valve apart.

* * * * *

UNITED STATES PATENT AND TRADEMARK OFFICE

CERTIFICATE OF CORRECTION

PATENT NO. : 5,719,610
DATED : February 17, 1998
INVENTOR(S) : Joseph E. Scheffelin It is certified that error appears in the above-indentified patent and that said Letters Patent is hereby corrected as shown below:

At Column 9, line 11, after "of claim", delete "2" and insert in lieu therof --1--.

At Column 12, line 9, after "initiated", delete "one of".

Signed and Sealed this

Twenty-fifth Day of August, 1998

Bruce Lehman

*Attest:*

BRUCE LEHMAN

*Attesting Officer*

*Commissioner of Patents and Trademarks*